US006257105B1

(12) United States Patent
Lin

(10) Patent No.: US 6,257,105 B1
(45) Date of Patent: Jul. 10, 2001

(54) REVERSIBLE JAW SNAP RING PLIERS

(76) Inventor: Shuh-Sen Lin, No. 12-2, Jiing-Chung Lane, Jiun-Gong Road, Beei-Twen Area, Tai-Chung City (TW)

( * ) Notice: Subject to any disclaimer, the term of this patent is extended or adjusted under 35 U.S.C. 154(b) by 0 days.

(21) Appl. No.: 09/467,069

(22) Filed: Dec. 20, 1999

(51) Int. Cl.[7] ..... B25B 7/12
(52) U.S. Cl. ..... 81/302; 29/229
(58) Field of Search ..... 81/302, 421, 422, 81/423, 427; 29/225, 229, 239

(56) References Cited

U.S. PATENT DOCUMENTS

| | | | | |
|---|---|---|---|---|
| 2,553,620 | * | 5/1951 | Yeazell | 81/302 |
| 3,390,445 | * | 7/1968 | Sova, Sr. | 29/229 |
| 3,484,924 | * | 12/1969 | Dahl | 29/229 |
| 3,990,137 | * | 11/1976 | Kulba et al. | 81/302 |
| 4,316,315 | * | 2/1982 | Vogelnik | 29/229 |
| 4,793,224 | * | 12/1988 | Huang | 81/302 |
| 5,483,732 | * | 1/1996 | Wang | 29/229 |
| 5,542,167 | * | 8/1996 | Nakamoto | 29/229 |

* cited by examiner

*Primary Examiner*—Eileen P. Morgan
*Assistant Examiner*—Joni B. Danganan
(74) *Attorney, Agent, or Firm*—Dougherty & Troxell

(57) ABSTRACT

A reversible jaw snap ring pliers equipped with a single pair of jaws having tips disposed at both ends that can be alternated directionally for snap ring installation and removal which is comprised of similarly shaped handles contiguous to two one-piece overlaid mounting sections coupled by a joint and jaws assembled onto the handles. The handles have a set of projecting mounting pins that are disposed in alignment at the upper extent of a joint section, and formed in the jaws are insertion holes matching the arrangement of the mounting pins on the handles that enable the assembly of the jaws onto the handle mounting pins. Among the innovative features, the jaws are structurally capable of bi-directional engagement to compress or distend snap rings, with straight pointed tips constructed at one end and curved pointed tips constructed at the other end. Furthermore, by alternating the direction of the straight pointed tips and the curved pointed tips, the user can as required engage the end holes of snap rings vertically or horizontally and, furthermore, install and remove snap rings with the exceptionally practical, easy to fabricate, and low cost reversible jaw snap ring pliers of the invention herein.

2 Claims, 6 Drawing Sheets

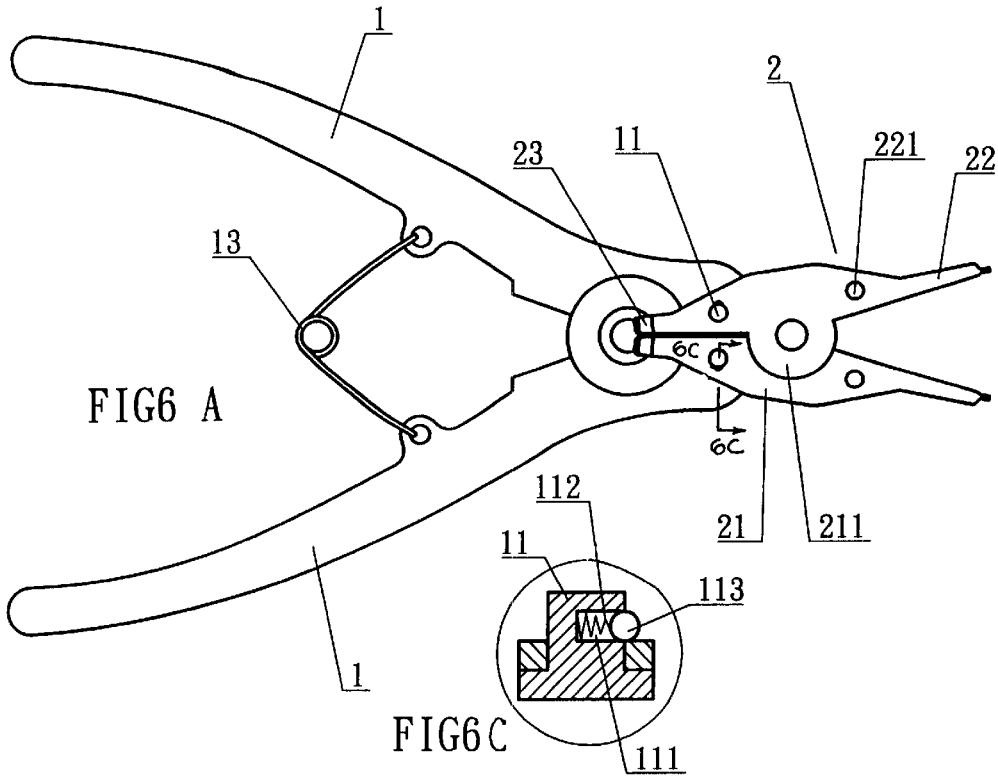
FIG6 A
FIG6C
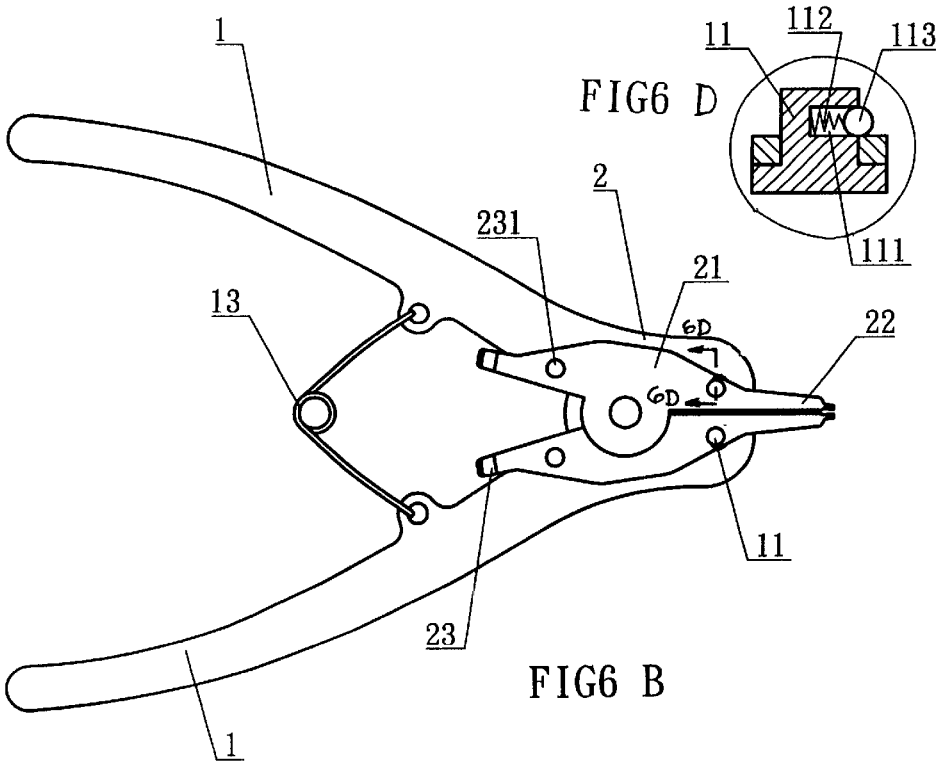
FIG6 D
FIG6 B

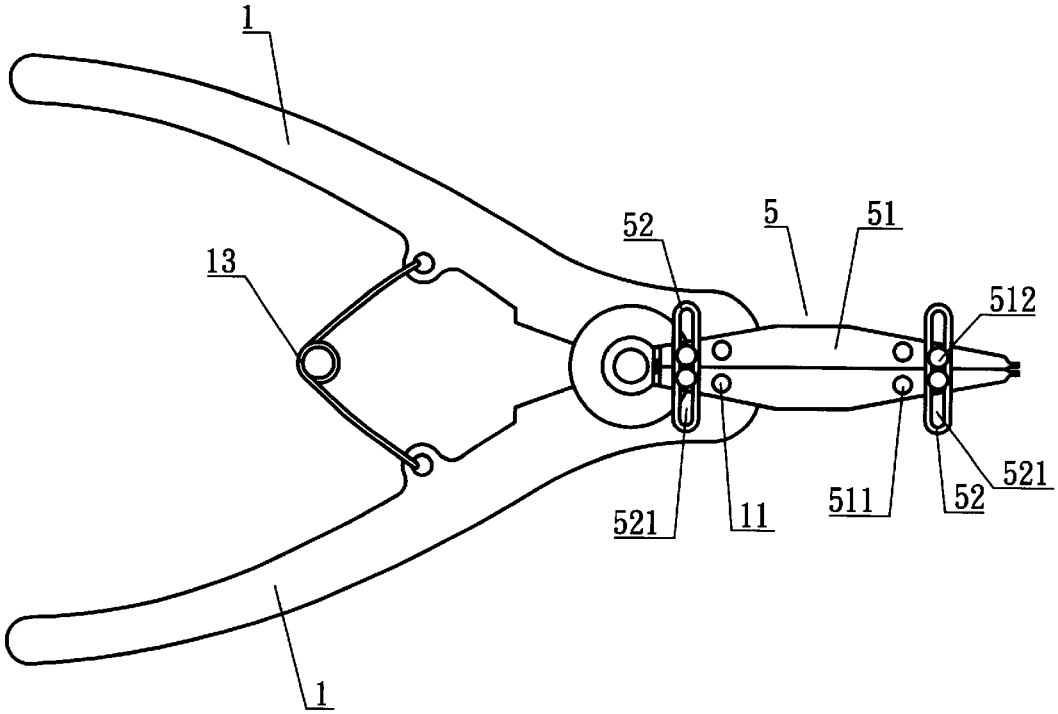
FIG7-A
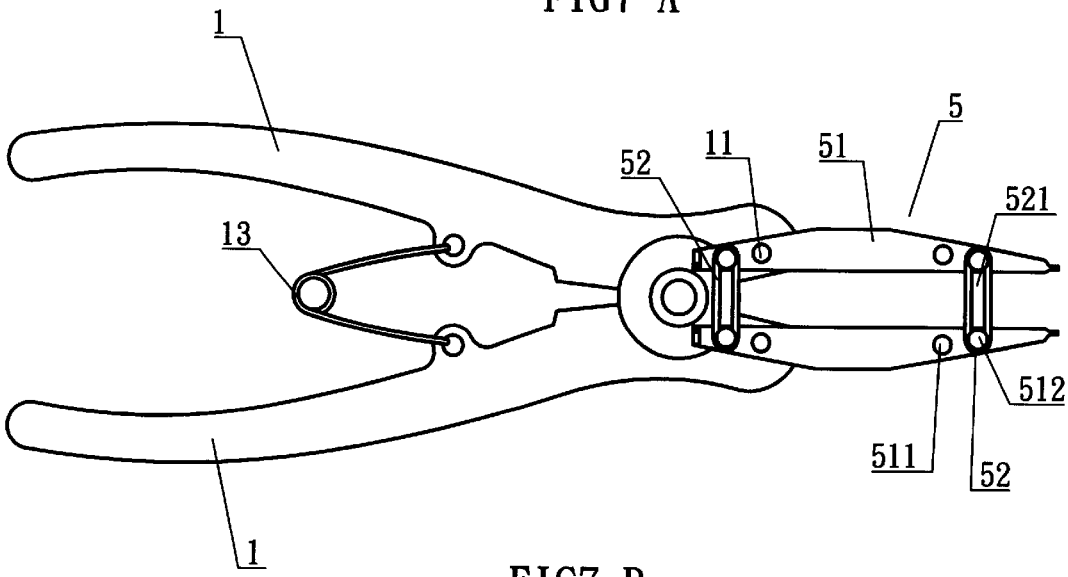
FIG7-B

REVERSIBLE JAW SNAP RING PLIERS

BACKGROUND OF THE INVENTION

1) Field of the Invention

The invention herein relates to a reversible jaw snap ring pliers comprised of similarly shaped handles contiguous to two one-piece overlaid mounting sections coupled by a joint and jaws assembled onto the handles, with the innovative features including jaws that are structurally capable of bi-directional engagement, with straight pointed tips constructed at one end and curved pointed tips constructed at the other end and, furthermore, by alternating the direction of the straight pointed tips and the curved pointed tips, the user can as required engage the end holes of snap rings vertically or horizontally and thereby install and remove snap rings.

The reversible jaw snap ring pliers of the present invention is capable of the distension or compression of snap rings to thereby manually seat or unseat snap rings to and from grooves machined along the outer diameters of shafts and the inner diameters of holes and openings.

2) Description of the Prior Art

Referring to FIG. 1 and FIG. 2, there are generally two types of conventional snap ring pliers in common usage at present. The snap ring pliers shown in FIG. I is comprised of similarly profiled handles 1 contiguous to two overlaid one-piece mounting sections coupled by a joint and jaws 6 pinned to the joint section; of which, a set of aligned protrusions are situated at the upper and lower extent of the joint section of the said handles 1 and, furthermore, projecting in opposite directions from the upper and lower ends are mounting pins 11 (i.e., the upper end mounting pins face inward and the lower end mounting pins face outward); disposed at an appropriate location along the middle section of the handles 1 is a tab 1 that provides for the installation of a spring component 13 that maintains the two handles 1 in an opened state; the said jaws 6 are straight and pointed in appearance and, furthermore, have insertion holes 61 that match the arrangement of the mounting pins 11 and thereby enable them to be sleeved onto the mounting pins 11 of the handles 1; as such, user requirements are met in that assembling the jaws 6 onto the mounting pins 11 at the upper end and the lower end enables the two sides of the handles 1 to be moved apart or brought together so users can vertically achieve the seating of snap rings into grooves machined along the outer diameters of shafts and the inner diameters of holes and openings.

The conventional snap ring pliers shown in FIG. 2 is comprised of the same arrangement of the handles 1 depicted in FIG. 1, but is equipped with jaws 7 that are curved and pointed with insertion holes 71, which enables users to horizontally achieve the seating of snap rings into grooves machined along the outer diameters of shafts and the inner diameters of holes and openings.

However, the said conventional snap ring pliers do not function as expected during actual utilization, with the shortcomings summarized below.

1. Impracticality

When the conventional snap ring pliers are utilized vertically to distend or compress a snap ring in a shaft hole, the straight pointed jaws 6 must be assembled to the top end of the handles 1 to enable their direct insertion into the end holes of the snap ring necessary for accomplishing installation or removal; however, if it is to be utilized horizontally to distend or compress a snap ring in a shaft hole, the curved pointed jaws 7 must be assembled to the top end of the handles 1 such that after the horizontal insertion, the end holes of the snap ring are directly engaged to accomplish installation or removal; as a result, jaw shapes must be frequently alternated as required during utilization which leads to troublesome usage; furthermore, since there are two types of Jaws 6 and 7 that must be respectively assembled, both types must be kept in a common place to facilitate alternation as needed, with the misplacement of either type of jaw precluding the full utilization of the tool as claimed by its original design objectives.

2. Higher Production Cost

Since the conventional snap ring pliers involve the assembly of two differently shaped jaws 6 and 7 onto the handles 1 to enable users to alternate jaw shapes as required, during the production of the said jaws, the fabrication of the two differently profiled jaws involves the use of two respective molds, which not only complicates production, but also involves a wastage of raw materials in that two separate jaws have to be fabricated, which leads to higher production cost.

In view of the said shortcomings, the inventor of the invention herein conducted extensive research, including repeated testing and refinement, which culminated in the successful development of an entirely original reversible jaw snap ring pliers that eliminates the said shortcomings of the conventional products and, furthermore, is capable of providing significantly greater practical performance.

SUMMARY OF THE INVENTION

The primary objective of the invention herein is to provide a reversible jaw snap ring pliers of excellent practicality that is comprised of similarly shaped handles contiguous to two one-piece overlaid mounting sections coupled by a joint and jaws assembled onto the handles; of which, the said handles have a set of projecting mounting pins that are disposed in alignment at the upper extent of a joint section, and formed in the jaws are insertion holes matching the arrangement of the mounting pins of the handles that enable the assembly of the jaws onto the handle mounting pins; the innovative features include jaws that are structurally capable of bi-directional engagement, with straight pointed tips constructed at one end and a curved pointed tips constructed at the other end; furthermore, by alternating the direction of the straight pointed tips and the curved pointed tips, the user can as required engage the end holes of snap rings vertically or horizontally and, furthermore, install and remove snap rings; as such, the reversible jaw snap ring pliers of the invention herein is capable of achieving exceptional practicality.

Another objective of the invention herein is to provide a reversible jaw snap ring pliers that involves lower production costs and in which the innovatively structured jaws can be directionally alternated as per user requirements for the vertical and horizontal engagement into the end holes of snap rings to accomplish their installation and removal, thereby only requiring a single mold during production to fabricate single pairs of jaws having two different application orientations and, furthermore, fabrication is not only simpler, but also reduces raw materials consumption and thereby decreases the overall production cost.

To enable the examination and to further understand the structure, innovative features, functions, and other practical objectives of the invention herein, the brief description of the drawings below are followed by the detailed description of the invention herein.

BRIEF DESCRIPTION OF THE DRAWINGS

FIG. 6-A is an orthographic drawing of the invention herein that is depicted in the opened state.

FIG. 6-B is an orthographic drawing of the invention herein that is depicted in the closed state.

FIG. 6C is an enlarged cross-sectional view taken along line 6C—6C in FIG. 6A.

FIG. 6D is an enlarged crossectional view taken along line 6D—6D in FIG. 6B.

FIG. 7-A is an orthographic drawing of another embodiment of the invention herein that is depicted in the opened state.

FIG. 7-B is an orthographic drawing of another embodiment of the invention herein that is depicted in the closed state.

DETAILED DESCRIPTION OF THE INVENTION

Figure 1:
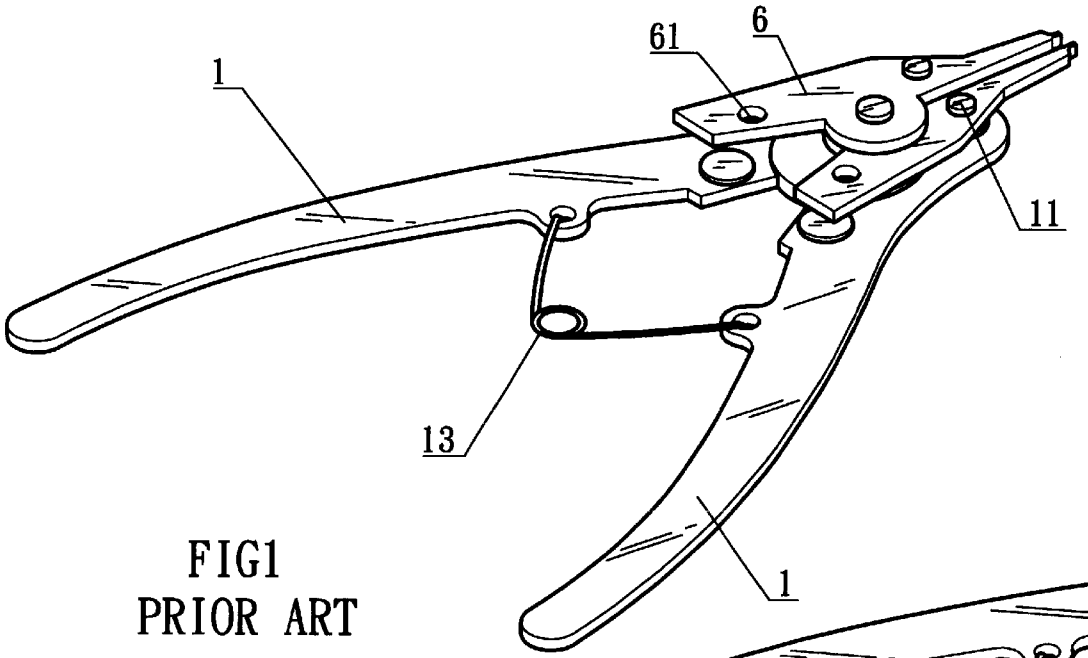
FIG1 PRIOR ART
FIG. 1 is an isometric drawing of the prior art.
Figure 2:
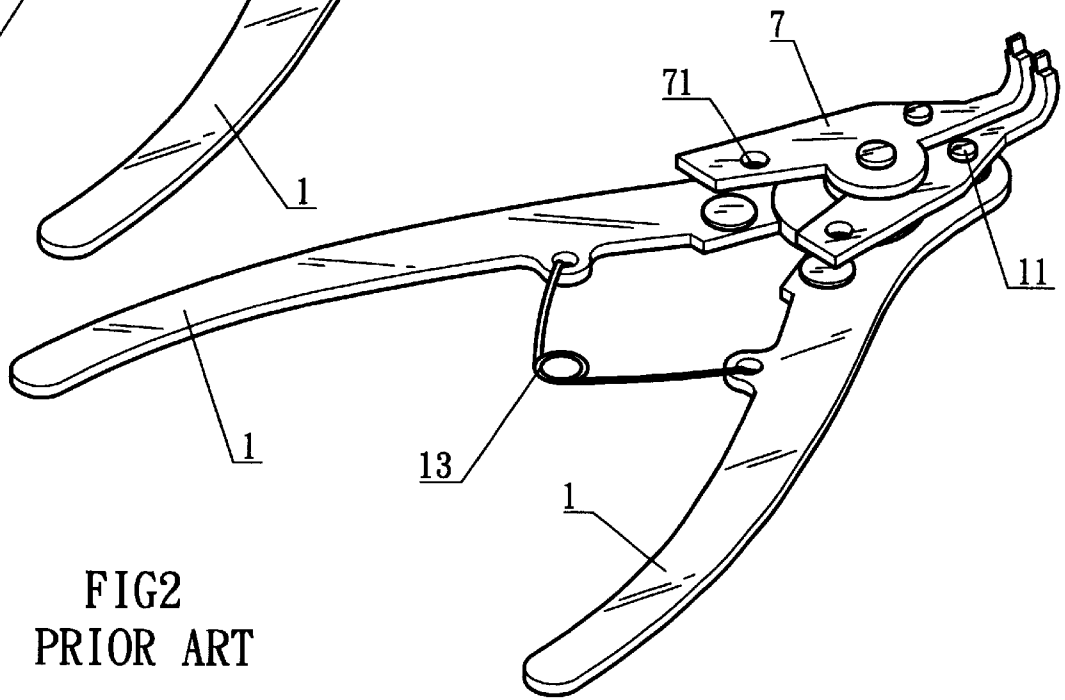
FIG2 PRIOR ART
FIG. 2 is an isometric drawing of the prior art.
Figures 3A, 3B:
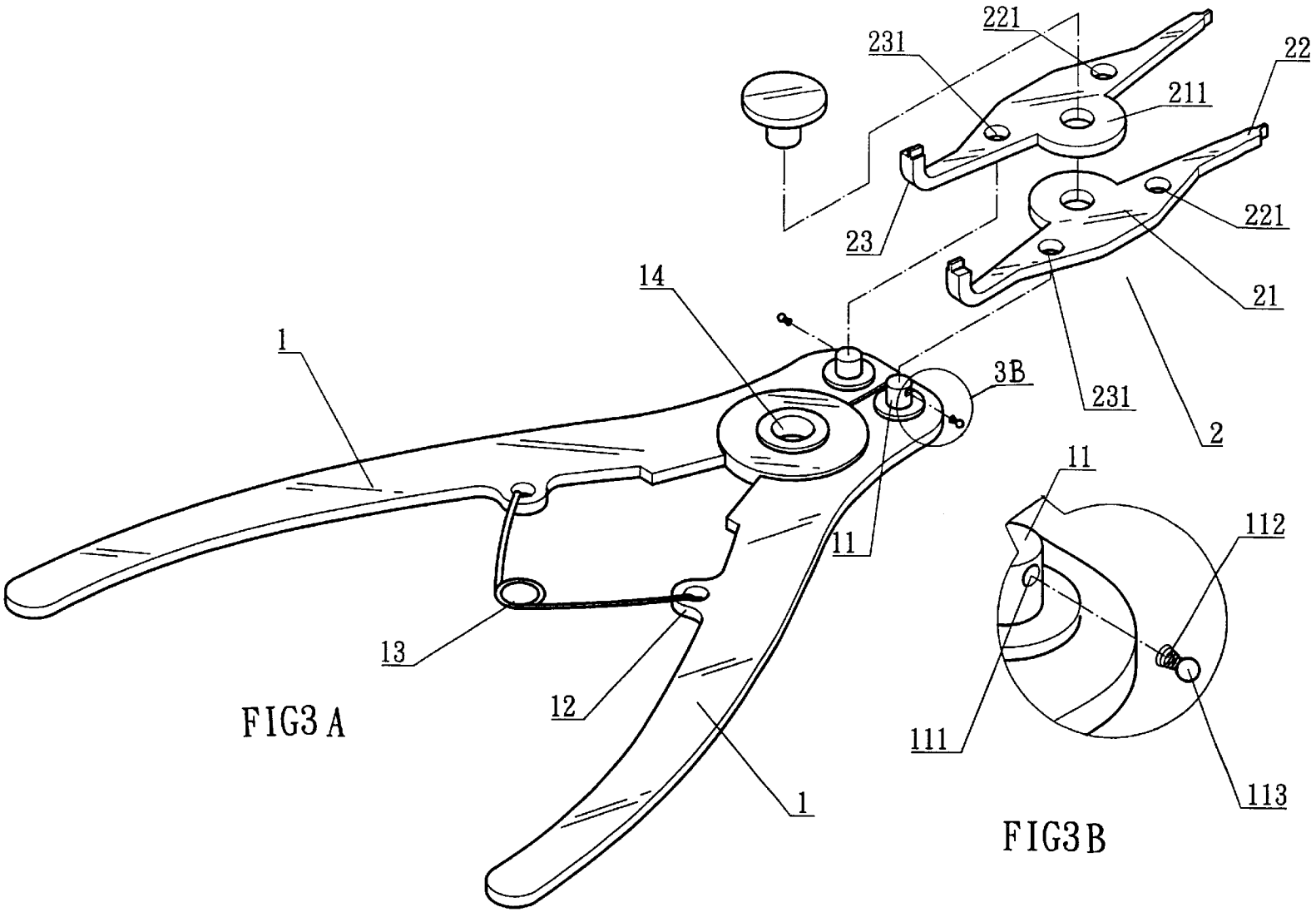
FIG. 3A is an exploded drawing of the invention herein.
FIG. 3B is an enlarged view of area 3B in FIG. 3A.
Figure 4:
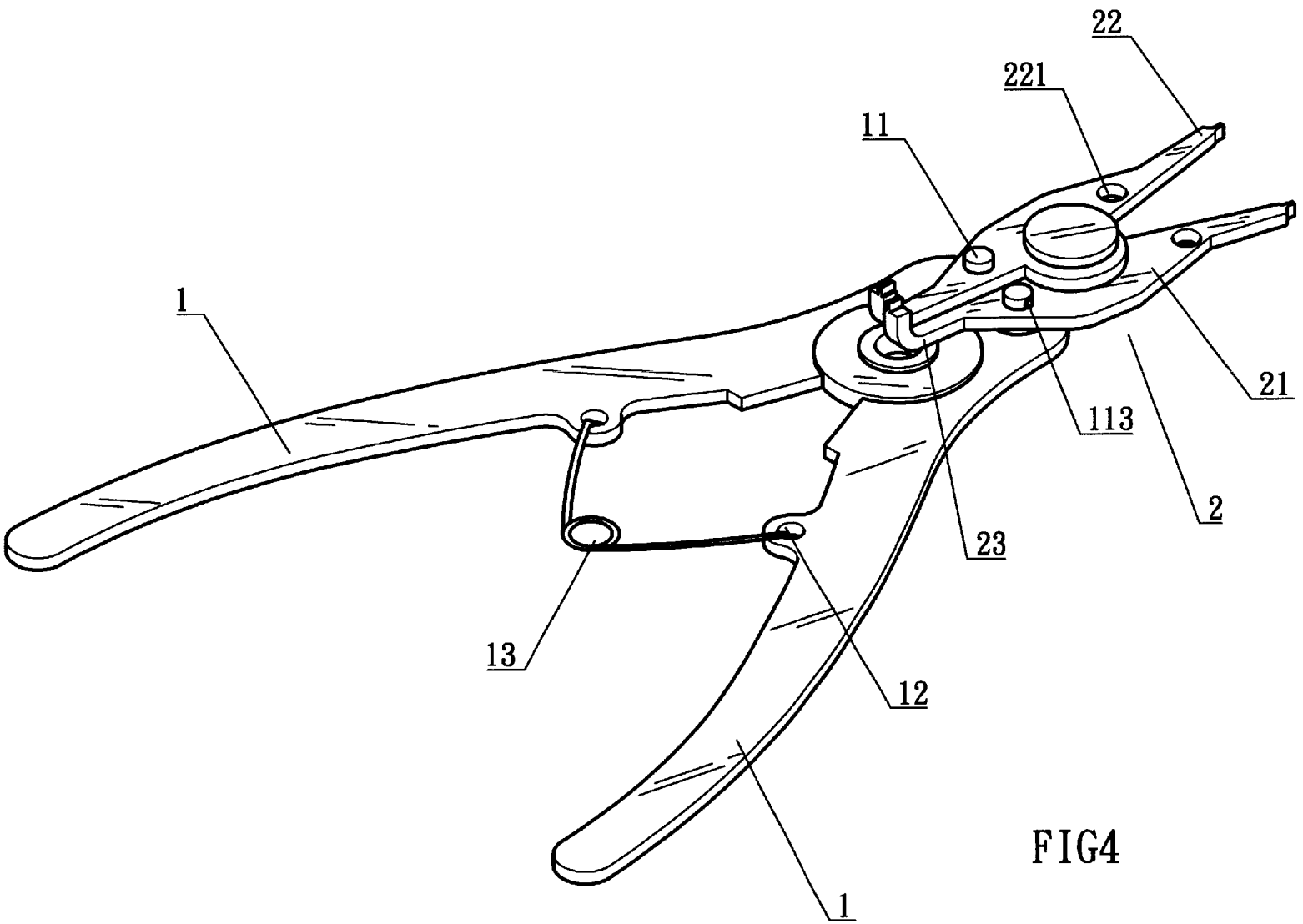
FIG. 4 is an isometric drawing of the invention herein.
Figure 5:
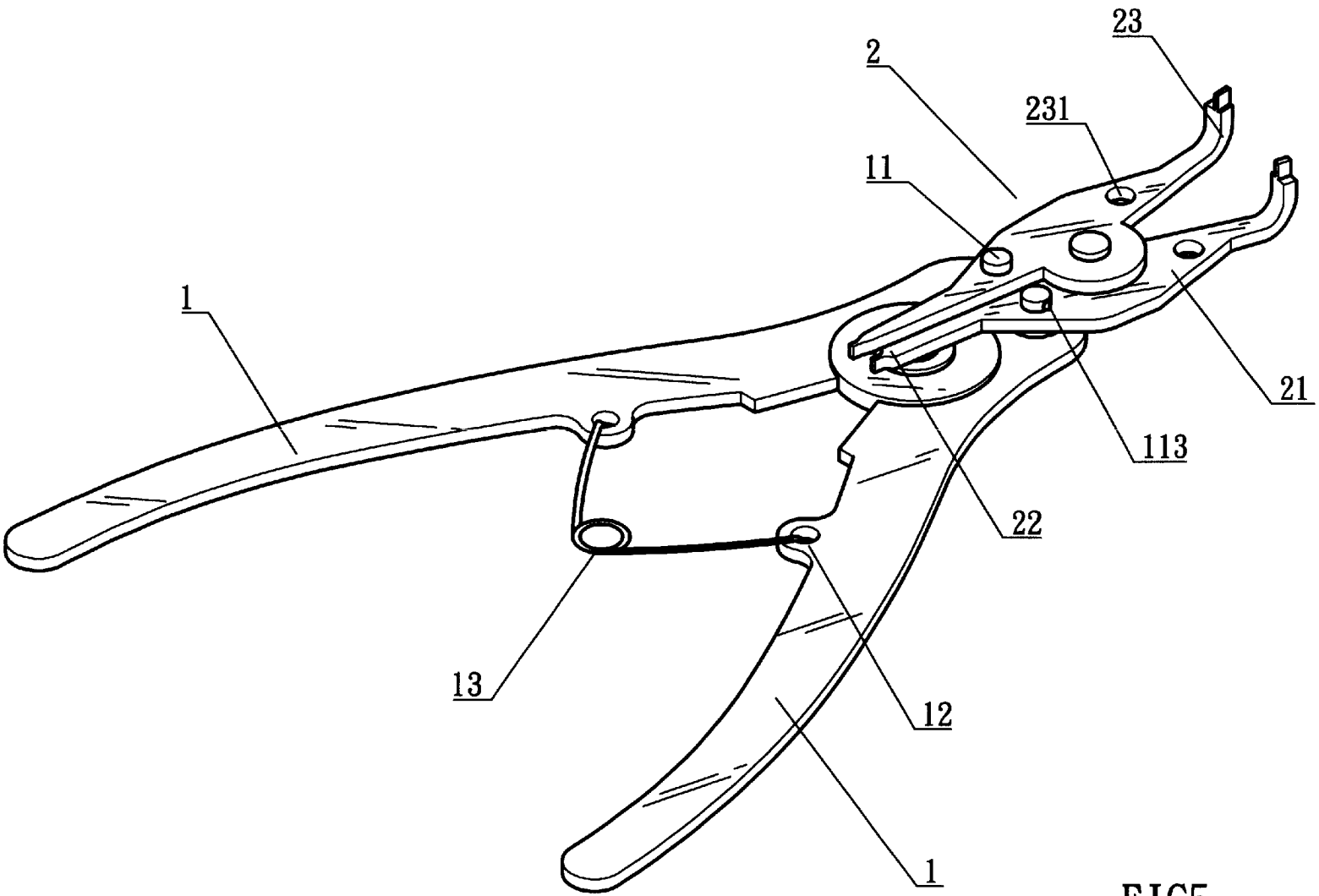
FIG. 5 is an isometric drawing of the invention herein with the jaws reversed.

Referring to FIG. 3, FIG. 4, and FIG. 5, the structural arrangement of the invention herein is comprised of similarly shaped handles 1 contiguous to one-piece overlaid mounting sections coupled by a joint and jaws 2 assembled onto the handles 1.

The said handles 1 have projecting mounting pins 11 that are disposed in alignment at the upper extent of the joint section 14, with a tab 12 formed appropriately at the center section of each of the handles 1 that provides for the insertion of a spring component 13 that maintains the two handles 1 in an opened state.

The said jaws 2 consist of two symmetrical elements, with each of the one-piece jaw elements 21 having a protruding section 211 formed at the middle aspect, the center points of which demark the area of intersectional pivoting; formed in the jaws 2 are insertion holes 221 and 231 matching the arrangement of the mounting pins 11 of the handle 1 that enable the mounting of the jaws 2 onto the mounting pins 11 of the handle 1.

The innovative features are: the said jaws 2 are structurally capable of bi-directional engagement, with straight pointed tips 22 constructed at one end and curved pointed tips 23 constructed at the other end; furthermore, a containing hole 111 is formed in each of the handle mounting pins 11 for the installation of a spring 112, one end of which is against the rear aspect of the containing hole 111, with a ball bearing 113 situated at the other end of the spring 112 and, furthermore, when the ball bearings 113 are in a state of rest, they protrude partially from the mounting pins 11; when the insertion holes 221 or 231 of the jaws 2 are sleeved onto the handle mounting pins 11, the circumferential edges of the insertion holes 221 and 231 in the jaws 2 press against the ball bearings 113, thereby compressing the springs 112 and causing the ball bearings 113 to recede inward such that after the insertion holes 221 and 231 pass by, the ball bearings 113 are pushed back out to retain the jaws 2 on the mounting pins 11.

By alternating the direction of the straight pointed tips 22 and the curved pointed tips 23, the user can as required engage the end holes of snap rings vertically or horizontally and, furthermore, install and remove snap rings with the exceptionally practical, easy to fabricate, and low cost reversible jaw snap ring pliers of the invention herein.

Referring to FIGS. 6A–6D, when the insertion holes 231 of the curved pointed tips 23 are sleeved onto the mounting pins 11 at the end of the handles 1, statically engaging a snap ring causes the straight pointed tips 22 to move outward, while the curved pointed tips 23 are brought into structural closure (as indicated in FIG. 6-A); when the insertion holes 221 of the straight pointed tips 22 are sleeved onto the mounting pins 11 at the end of the handle 1, statically engaging a snap ring causes the closure of the straight pointed tips 22, while the curved pointed tips 23 are structurally moved outward (as shown in FIG. 6-B) and as such, capable of being directly engaged into the end holes of a snap ring for its installation or removal.

Referring to FIG. 7, another embodiment of the invention herein is comprised of similarly shaped handles 1 contiguous to two mounting sections coupled by a joint and jaws 5 assembled onto the mounting pins 11 of the handles 1; of which: the said jaws 5 consist of two jaw elements 51 in a parallel arrangement, an insertion hole 511 formed at an appropriate position in the jaw elements 51, and retaining tabs 52 affixed to each of the jaw elements 51; a locating rod 512 is appropriately mounted at the upper and lower ends of the said jaw elements 51 and, furthermore, a position limiter hole 521 is formed in each retaining tab 52 to accommodate the placement of the jaw element 51 locating rods 512 in the position limiter holes 521 of the retaining tabs 52; when the insertion holes 511 of the jaw elements 51 are sleeved onto the mounting pins 11 at the upper ends of the handles and a snap ring is statically engaged, the structure opens in parallel (as shown in FIG. 7-A); when the user squeezes the handles 1 together, the jaws 5 follow the opening and extending action of the handles 1 and, furthermore, the jaws 5 are capable of opening up to the locating rods 512 of the jaws 5 situated against the position limiter holes 521 of the catch tabs 52 (as shown in FIG. 7-B) and as such, are capable of being directly engaged into the end holes of snap rings for their installation or removal.

In summation of the foregoing section, since the reversible jaw snap ring pliers invention herein features an innovative structure, is capable of achieving the original objectives and, furthermore, provides greater practical performance than products of the prior art, the present invention meets all new patent application requirements and is lawfully submitted for review and the granting of the commensurate patent rights to thereby encourage the spirit of invention and its rightful protection under the patent law.

What is claimed:

1. Reversible jaw snap ring pliers comprising:

a) a pair of handles pivotally connected together at a first pivot joint, each handle having a handle section and a mounting section located on opposite sides of the pivot joint such that movement of the handle sections towards each other moves the mounting sections away from each other and vice versa;

b) two jaw members pivotally connected together at a second pivot joint, each jaw member having a first end with a straight pointed tip for engaging a snap ring and a second, opposite end with an angled pointed tip for engaging a snap ring, the straight and angled tips located on opposite sides of the second pivot joint;

c) first and second insertion holes formed in each jaw member located on opposite sides of the second pivot joint; and, d) a mounting pin extending from each mounting section so as to engage one of the first and second insertion holes whereby the jaw members may be connected to the mounting sections in a first position wherein the straight tips are in an operative position, or a second position wherein the angled tips are in an operative position and in each of the first and second jaw member positions, the first and second pivot joints may be located with respect to each other such that the tips in the operative position move toward each other when the handle sections are moved toward each other, or such that the tips in the operative position move away from each other when the handle sections are moved toward each other.

2. The reversible jaw snap ring pliers of claim 1 further comprising a ball latching mechanism in each of the mounting pins to releasably latch the jaw members onto the mounting sections.

* * * * *